United States Patent [19]

De'Longhi

[11] Patent Number: 4,895,004

[45] Date of Patent: Jan. 23, 1990

[54] AIR CONDITIONING APPARATUS

[75] Inventor: Giuseppe De'Longhi, Treviso, Italy

[73] Assignee: Miralfin S.R.L., Treviso, Italy

[21] Appl. No.: 249,323

[22] Filed: Sep. 26, 1988

[30] Foreign Application Priority Data

May 13, 1988 [IT] Italy ..... 20576 A/88

[51] Int. Cl.[4] ..... F25B 39/04

[52] U.S. Cl. ..... 62/506; 62/305

[58] Field of Search ..... 62/506, 507, 183, 305, 62/428

[56] References Cited

U.S. PATENT DOCUMENTS 2,181,354 11/1939 Winters ..... 62/506 X
2,296,997 9/1942 Knoy ..... 62/506 X
3,264,843 8/1966 Ulich ..... 62/262
3,926,008 12/1975 Webber ..... 62/506 X
4,516,407 5/1985 Watabe ..... 62/506 X

*Primary Examiner*—William E. Tapoical
*Attorney, Agent, or Firm*—Abelman Frayne Rezac & Schwab

[57] ABSTRACT

The apparatus for conditioning the air in a room comprises a frame (2) supporting means (3) for compressing a fluid, means (4) for its condensation and means (5) for its evaporation and means (6) for cooling the condensing means; the condensing means comprise at least one first condenser (7) for the air-cooling of the liquid and at least one second condenser (8) for the water-cooling thereof.

1 Claim, 2 Drawing Sheets

AIR CONDITIONING APPARATUS

Figure 1:
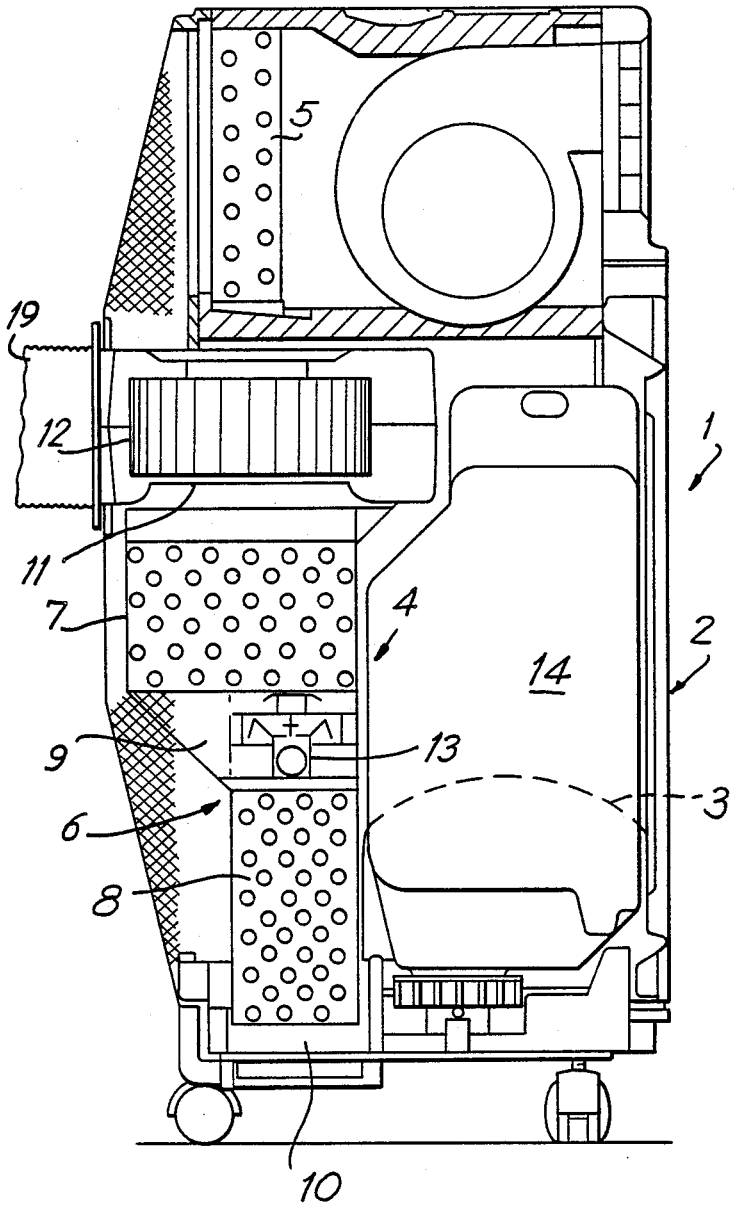

The present invention relates to an apparatus for conditioning the air in a room.

As is known, devices for conditioning air are currently available on the market in which the cooling of the single condenser is obtained by striking the freon-conveying tube nests with which it is equipped either with air or with water.

In the case of so-called air/air conditioners, in which the cooling of the fluid is performed with air, these conditioners, though they have the advantage of being simple in construction, have the disadvantage that they have an extremely low efficiency since the action which they perform practically mostly consists of dehumidifying air.

This disadvantage, as is easily understood, arises from the fact that the conditioned air is sucked by the apparatus in considerable amounts to cool its own condenser from the same room which is to be cooled and is then expelled outside.

In the case of conditioners of the water-cooled type with evaporative condenser, instead, the efficiency of the apparatus is considerably higher, as a preset amount of water is used to cool the condenser and the steam which is produced is then expelled outside.

This last type of conditioner is subject, however, in the course of time, to harmful formations of calcareous deposits in the regions affected by the water and in particular on the condenser which, after more or less long periods of time, must be replaced.

Furthermore the independent operating time of the apparatus depends exclusively on the capacity of the water tank.

The aim of the invention is to eliminate the disadvantages described above by providing an apparatus for conditioning the air in a room which allows high flexibility in operation, as it can operate with air- or water-cooling of its condenser.

Within the scope of this aim, an important object of the invention is to provide an apparatus for conditioning the air in a room which, though it operates with water-cooling of its condenser, considerably reduces the formation of calcareous deposits in the regions affected by the water and especially in its condenser.

Still another object of the present invention is to provide an apparatus for conditioning the air in a room which allows an extremely large saving in water for the cooling of the condenser.

Not least object of the present invention is to provide an apparatus for conditioning the air in a room which, during its operation, prevents the forming of condensation in the steam discharge tube, eliminating troublesome drippings in its interior with a consequent useless waste of water.

This aim, as well as these and other objects, are achieved by an apparatus for conditioning the air in a room, comprising a frame supporting means for compressing a fluid, means for condensing said fluid and means for evaporating it and means for cooling said condensing means, characterized in that said condensing means comprise at least one first condenser for the air-cooling of said fluid and at least one second condenser for the water-cooling thereof.

Figure 2:
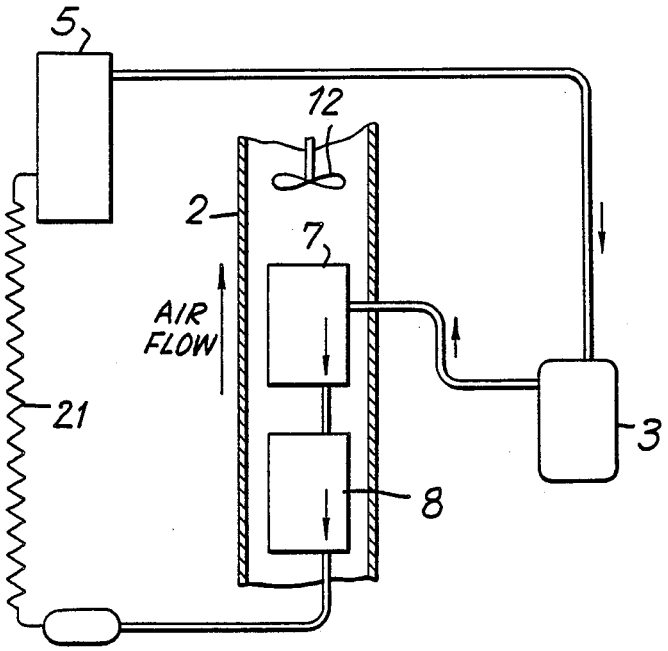

Further characteristics and advantages of the invention will become apparent from the description of a preferred but not exclusive embodiment of the apparatus according to the invention, illustrated only by way of non-limitative example in the accompanying drawings, wherein:

FIG. 1 is a lateral elevation view, in transverse cross section, of the air-conditioning apparatus according to the invention; and FIG. 2 is a schematic view of the cooling cycle of the apparatus according to the invention.

With particular reference to FIG. 1, the apparatus for conditioning the air in a room according to the invention, generally indicated by the reference numeral 1, comprises a frame 2 which supports means 3 for compressing a fluid, e.g. freon, means 4 for condensing said fluid and means 5 for evaporating it, and means, generally indicated by the reference numeral 6, for cooling the condensing means 4.

Advantageously, the condensing means 4 comprise at least one first condenser 7, for example but not necessarily of the finned type for the air-cooling of the freon and at least one second condenser 8, for example but not necessarily of the tube type for the water-cooling thereof, hereinafter termed finned condenser and tube condenser for the sake of simplicity.

Conveniently, the finned condenser 7 and the tube condenser 8 are mutually associated to allow the flow of freon from the former towards the latter and furthermore to simultaneously allow the passage, in the opposite direction to the freon, of a preset volume of air which sequentially strikes first the tube condenser and then the finned condenser.

As can be seen in FIG. 2, the freon of the tube condenser 8 flows through a filter 20 and from said filter, through an also known capillary tube 21, to the evaporator 5 to return into the compressor 3.

More precisely, the finned condenser 7 and the tube condenser 8 are accommodated in a chamber 9, provided in the frame 2, which has a first opening 10 downwardly connected to the outside and a second opening 11 upwardly connected to a fan 12 for sucking the required volume of air.

The means for water-cooling the tube condenser 8 comprise at least one water delivery element, generally indicated by the reference numeral 13 and comprised between the finned condenser and the tube condenser, with the same direction as that of the flow of freon.

Laterally to the finned condenser and to the tube condenser, the apparatus comprises a water container 14 for feeding the delivery element by means of a pump not illustrated in the drawings.

More in detail, the tube condenser 8 is arranged in the chamber 9 below the finned condenser 7 so that the longitudinal axes of the finned condenser and of the tube condenser are substantially mutually orthogonal.

With this arrangement, when the fan 12 is operating, the volume of air entering the first opening 10 and exiting from the second opening 11, in the case of air-cooling of the freon, undercools it in the tube condenser and, in the case of water-cooling of the freon, pre-cools it in the finned condenser.

From the above it is easily understood that by virtue of the pre-cooling to which the freon is subject in the finned condenser before it flows into the tube condenser it is possible to considerably ; reduce the formation of calcareous deposits thereon.

Furthermore, the presence of the finned condenser prevents the water particles from being expelled during the cooling of the tube condenser and prevents the heating of the steam which has formed during this operation by passing through the finned condenser, so that the expelled air has a relatively low relative humidity.

This fact avoids the formation of condensation in the steam discharge tube 19 and therefore prevents troublesome drippings in its interior.

The operation of the apparatus for conditioning the air in a room is evident from what has been described and illustrated; in particular by switching the conditioner on the suction fan is activated automatically and, for example if the apparatus is water-cooled, creates an air current which flows through the tube condenser and subsequently through the finned condenser, providing a pre-cooling of the fluid circulating therein, which is then finally cooled, in the tube condenser, by the water.

In this case the finned condenser has the function of a separator, retaining the aqueous particles and preventing them from being expelled from the apparatus with a consequent saving in water of approximately 40%.

If, after a period of operation, the water in the container is depleted, the conditioner automatically or controllably shifts to operation with air-cooling, and the suction fan automatically increases its rpm rate, causing the flow, through the tube condenser 8 and then through the finned condenser 7, of a volume of air suitable to cool the fluid circulating in the two condensers.

In this step the tube condenser allows an undercooling of the circulating fluid, furthermore increasing the efficiency of the apparatus.

In practice it has been observed that the apparatus for conditioning the air in a room is particularly advantageous in that it has high flexibility in operation, as it can operate with air-cooling or water-cooling of the condenser and, in the latter case, the formation of calcareous deposits in the regions affected by the water and especially in the condenser of the apparatus is considerably reduced, furthermore obtaining a considerable saving in water for cooling the condenser.

The presence of the finned condenser furthermore prevents, during operation, the forming of condensation in the steam discharge tube, eliminating troublesome drippings in its interior.

The invention thus conceived is susceptible to numerous modifications and variations, all of which are within the scope of the inventive concept; furthermore all the details may be replaced with technically equivalent elements.

In practice, the materials employed, as well as the dimensions, may be any according to the requirements and to the state of the art.

Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

I claim:

1. Air conditioning apparatus of the type including a compressor for refrigerant fluid, a first heat exchanger for cooling compressed refrigerant fluid, an expander for expanding said cooled refrigerant fluid, and a second heat exchanger in which said expanded refrigerant fluid is heated, further including:

a first section of said first heat exchanger, and a second section of said first heat exchanger, said first section being arranged vertically above said second section;

means for traversing cooling air serially upwardly across said second section and then said first section;

a connection from said compressor to an upper end of said first section;

a connection from a lower end of said first section to an upper end of said second section;

a connection from a lower end of said second section and said expander for compressed refrigerant fluid; and, selectively operable means for water cooling said second section;

whereby, when said water cooling means is operative, said heated refrigerant fluid from said compressor is subjected to an initial decrease in temperature by air cooling in said first section, and is then subjected to a final decrease in temperature by combined air and water cooling in said second section, said initial decrease in temperature in said first section being operative to reduce the temperature of refrigerant fluid supplied to said second section and in turn reduce the rise in temperature and rate of evaporation of said coolant water employed for cooling said second section, cooling in said first section being further assisted by water vapor and droplets produced in said second section and entrained in the air flow traversing said second section, droplets trapped by said first section being returned by gravity to said second section; and, whereby, when said water cooling means is inoperative, cooling air of ambient temperature is first employed to cool said second section containing refrigerant fluid of lower temperature in order to provide maximum temperature differential at said second section, and is then employed to cool said first section.

* * * * *